US006239346B1

(12) United States Patent
Goto et al.

(10) Patent No.: US 6,239,346 B1
(45) Date of Patent: May 29, 2001

(54) MUSICAL TONE SIGNAL PROCESSING APPARATUS AND STORAGE MEDIUM STORING PROGRAMS FOR REALIZING FUNCTIONS OF APPARATUS

(75) Inventors: Kazuhiro Goto; Yoshihiro Inagaki, both of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/612,190

(22) Filed: Jul. 7, 2000

(30) Foreign Application Priority Data

Jul. 8, 1999 (JP) ..... 11-194695

(51) Int. Cl.[7] ..... G10H 7/02
(52) U.S. Cl. ..... 84/604
(58) Field of Search ..... 84/604–607

(56) References Cited

FOREIGN PATENT DOCUMENTS 2000-78170A 3/2000 (JP) .

*Primary Examiner*—Stanley J. Witkowski
(74) *Attorney, Agent, or Firm*—Morrison & Foerster

(57) ABSTRACT

A musical tone signal processing apparatus which synchronizes a read timing of a reader unit for reading a musical tone signal from a memory at least temporarily storing the musical tone signal, the musical tone signal processing apparatus comprising: a master clock input unit for externally inputting a master clock information used for synchronizing the read timing of the musical tone signal; a first sync clock generator unit for generating a first sync clock used for synchronizing the read timing of the musical tone signal, in accordance with the master clock information externally input; a second sync clock generator unit for generating a second sync clock used for synchronizing the read timing of the musical tone signal, separately from the first sync clock; a detector unit for detecting an abnormality of an input state of the master clock information; and a sync clock switching unit for changing a sync clock used for reading the musical tone signal from the first sync clock to the second sync clock, when said detector unit detects the abnormality of the input state of the master clock information.

31 Claims, 5 Drawing Sheets

MUSICAL TONE SIGNAL PROCESSING APPARATUS AND STORAGE MEDIUM STORING PROGRAMS FOR REALIZING FUNCTIONS OF APPARATUS

This application is based on Japanese Patent Application HEI 11-194695, filed on Jul. 8, 1999, the entire contents of which are incorporated herein by reference.

BACKGROUND OF THE INVENTION a) Field of the Invention

The present invention relates to a musical tone signal processing apparatus capable of generating an internal sync clock when an external sync clock becomes abnormal.

b) Description of the Related Art

Recent developments on networks allow a plurality of electronic musical instruments connected to networks to be played synchronously. As the standard specifications for communications between electronic musical instruments, Musical Instrument Digital Interface (MIDI) is known. Tempo clocks (F8) are used as timing signals for a synchronous performance between some of a plurality of electronic musical instruments or musical tone signal processing apparatuses connected to a network using MIDI. The tempo signal is converted into a MIDI signal and transmitted to other instruments or apparatuses via MIDI cables. Synchronously with this tempo clocks, the other instruments or apparatuses play a music performance.

Recent electronic musical instruments or musical tone signal processing apparatuses use high speed network connections such as USB and IEEE 1394 to realize faster synchronous performance. Synchronous performance is now possible not only at the level of simple automatic performance of MIDI signals but also at the level of reproduction timings of musical tone signal waveforms.

For synchronous performance at the level of timings of waveforms, a sync signal is generated from at least one of a plurality of electronic musical instruments or musical tone signal processing apparatuses connected to a high speed network using USB, IEEE 1394 or the like. This sync signal is very fast as compared to a MIDI signal. Therefore, this sync signal can be used not only for simple synchronous performance but also for timing clocks of a sound generator which reads waveforms.

Each of electronic musical instruments or musical tone signal processing apparatuses receives fast timing clocks from a high speed network, and performs a read operation, a reproduction operation or the like of waveform data synchronously with the received clocks.

More specifically, reproduction sampling clocks are generated in accordance with received sync data (such as a time stamp) and supplied to a sound generator (made of LSI or the like) as its clocks. In this manner, synchronous performance between instruments or apparatuses becomes possible at the level of read timings of waveform data.

Network troubles such as disconnection and transfer abnormality may occur during synchronous performance on the network interconnecting a plurality of electronic musical instruments or musical tone signal processing apparatuses. In such a case, data integrity or data transfer is not possible among some instruments or apparatuses. For example, if F8 does not reach unexpectedly during synchronous performance of MIDI data, each instrument or apparatus performs a dump process of the tone generator to effect an instant muting process.

It is therefore possible to prevent continuous reproduction of sounds or generation of abnormal noises to be caused upon occurrence of discontinuous phenomena.

In such a system in which sampling clocks are generated in accordance with sync data received from a high speed network and used as synchronizing clocks of a tone generator, however, if sampling clocks are suspended or become abnormal from some reasons, the tone generator itself cannot operate normally because of an abnormal state of its sampling clocks.

For example, even if the tone generator is instructed to execute the dump process, the muting process cannot be effected. Therefore, sounds continue to be reproduced or abnormal noises are generated.

SUMMARY OF THE INVENTION

It is an object of the present invention to provide a musical tone signal processing apparatus capable of dealing with abnormality of external sync clocks.

According to one aspect of the present invention, there is provided A musical tone signal processing apparatus which synchronizes a read timing of a reader unit for reading a musical tone signal from a memory at least temporarily storing the musical tone signal, the musical tone signal processing apparatus comprising: a master clock input unit for externally inputting a master clock information used for synchronizing the read timing of the musical tone signal; a first sync clock generator unit for generating a first sync clock used for synchronizing the read timing of the musical tone signal, in accordance with the master clock information externally input; a second sync clock generator unit for generating a second sync clock used for synchronizing the read timing of the musical tone signal, separately from the first sync clock; a detector unit for detecting an abnormality of an input state of the master clock information; and a sync clock switching unit for changing a sync clock used for reading the musical tone signal from the first sync clock to the second sync clock, when said detector unit detects the abnormality of the input state of the master clock information.

A circuit for generating a sampling sync signal from a network sync signal is provided with a signal generating circuit of an autonomous type for generating a signal corresponding to the sampling sync signal. Immediately after the external network signal becomes abnormal, the circuit is changed to the autonomous signal generating circuit so that reproduction sampling clocks can be supplied to a tone generator. It is therefore possible to prevent continuous reproduction of sounds or generation of abnormal noises which might be caused upon occurrence of network troubles.

A switch is provided at the front stage of a PLL circuit including a LPF. PLL can smooth an abrupt change in a clock when clocks are switched. Generation of abnormal noises or the like can therefore be prevented.

DETAILED DESCRIPTION OF THE PREFERRED EMBODIMENTS

Figure 1:
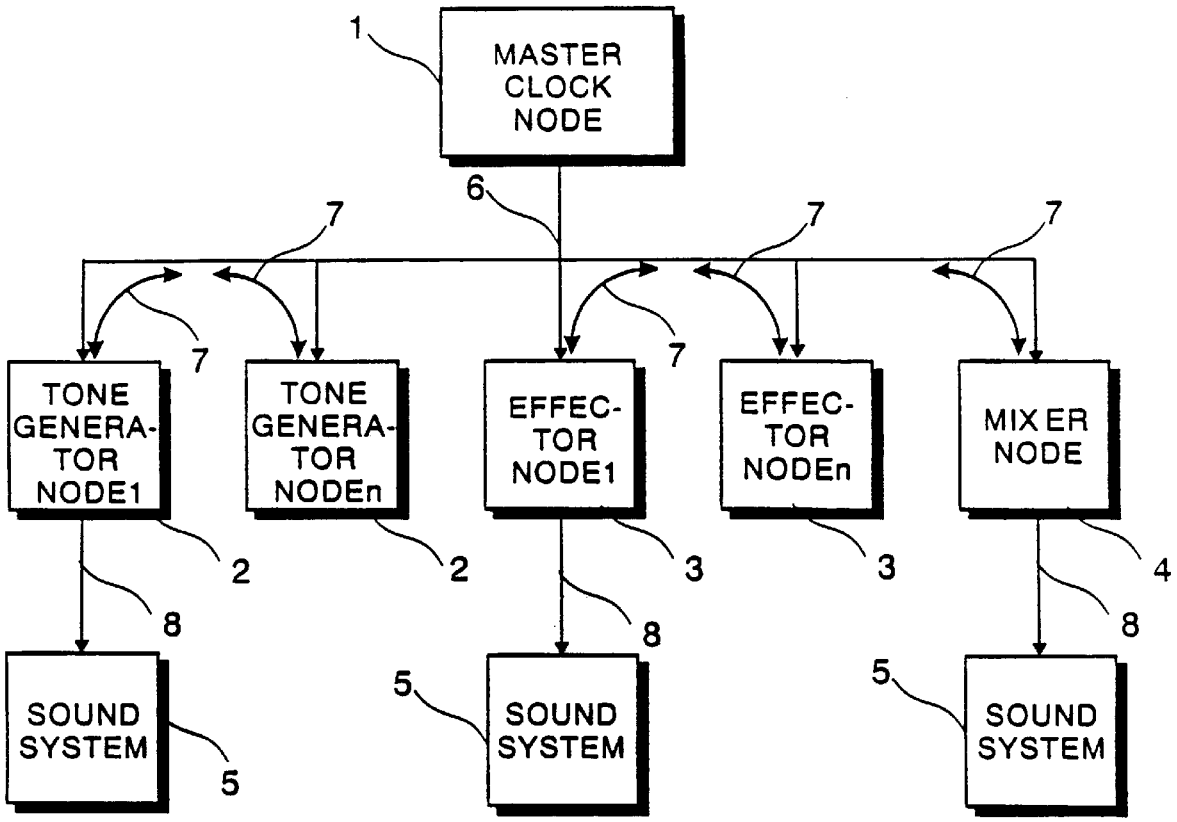
FIG. 1 is a block diagram showing an electronic musical instrument network.

FIG. 1 is a block diagram showing the structure of an electronic musical instrument network.

This network is a digital serial communications system using, for example, IEEE 1394 or USB.

The network is constituted of a plurality of nodes including a master clock node 1, tone generators 2, effectors 3 and a mixer 4. A single tone generator 2 and a single effector 3 may be used. The tone generators 2, effectors 3 and mixer 4 are each provided with a sound output system 5 having a speaker, an amplifier and the like.

The master clock node 1 generates a WC packet 6 which is used as a synchronizing time stamp. The WC packet 6 includes a system clock SYT and a sample count and is transmitted to each node via the network.

Each node receives the transmitted WC packet 6 and the internal circuit of the node generates sampling clocks. By using the sampling clocks, waveform data and audio signals are read or processed and output.

The output data is supplied to the sound system 5 as audio signals 8. The read or processed data is added with a time stamp, a header and the like and packetized in conformity with the specifications of IEEE 1394 or USB to transmit a data packet 7 to the network, when necessary. The data packet 7 contains a system clock SYT and sample data.

Each node may receive the data packet 7 transmitted from another node in the manner described above. Each node decodes the data packet 7 received from another node, and the decoded sample data is directly, or after being processed in accordance with the time stamp and header added to the data packet 7, output to the sound system 5 as audio signals 8.

Each node may packetize the received data and transmit it to the network, when necessary.

At least one master clock node 1 is used in the network. For example, the tone generator node 2 may have the function of the master clock node by transmitting a synchronizing time stamp to the network. Similarly, the effector node 3 or mixer node 4 may have the function of the master clock node.

Figure 2:
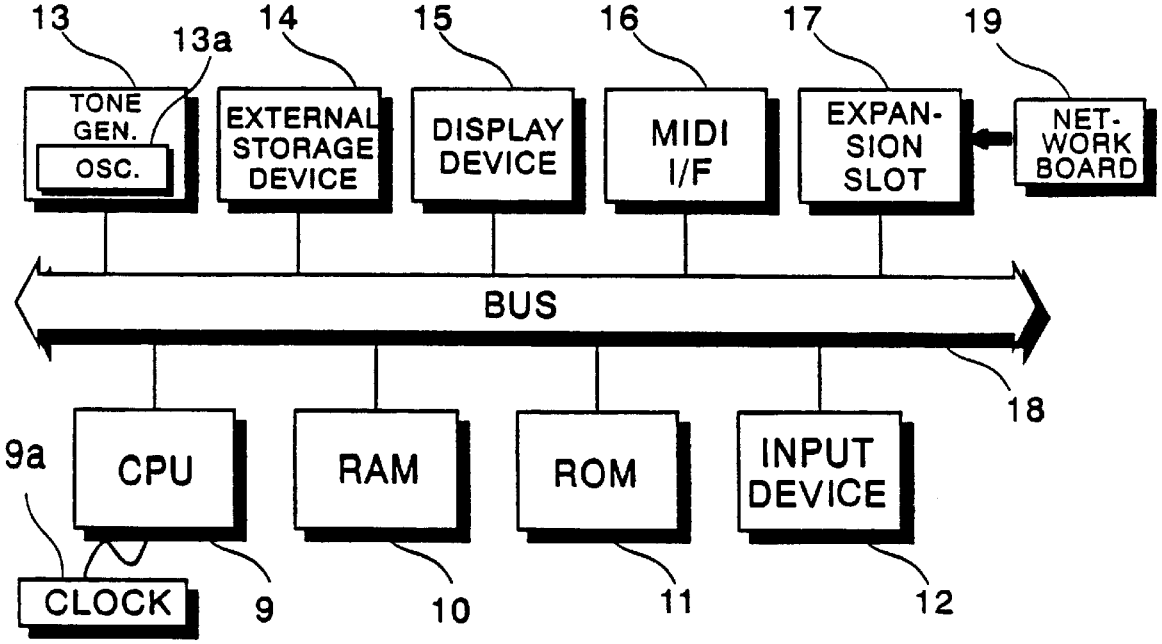
FIG. 2 is a block diagram showing the fundamental structure of a node constituting the network shown in FIG. 1.

FIG. 2 is a block diagram showing the fundamental structure of a node constituting the network shown in FIG. 1. A tone generator node is shown in FIG. 2 as one example of nodes. This node has the structure same as that of a general electronic musical instrument. The node has: a CPU 9; a system clock 9a; a RAM 10; a ROM 11; an input device 12 such as a keyboard, switches and a mouse; a tone generator 13; an external storage device 14; a display device 15; a communications interface (I/F) 16 for transfer of data such as MIDI data to and from an external node; and an expansion slot 17. These are interconnected by a bus 18.

The external storage device 14 is, for example, a hard disk drive, a floppy disk drive, a CD-ROM drive, a magnetooptical disk drive or the like, and can store therein MIDI data, waveform data, image data, computer programs or the like.

RAM 10 has a working area such as buffers and registers and can copy the contents stored in the external storage device 14 and store them. ROM 11 stores computer programs and various parameters.

CPU 9 executes various arithmetic operations and signal processing in accordance with the computer programs stored in RAM 10 or ROM 11. The system clock 9*a* generates time data. CPU 9 can execute an interrupt process by using the time data fetched from the system clock 9*a*.

The communications interface (I/F) 16 is a MIDI interface and can transfer MIDI data to and from an external apparatus connected by a MIDI cable.

The expansion slot 17 is used for inserting a high speed network board 19 or the like in order to connect to the network. The tone generator 13 is, for example, a PCM tone generator, an FM tone generator, a physical model tone generator or the like, and has a crystal oscillator 13*a*.

For example, if the high speed network board 19 is not inserted into the expansion slot 17, clocks are automatically supplied from the crystal oscillator 13*a* and synchronously with the clocks the tone generator 13 reads a sampling event of waveform data from a waveform memory and produces sounds.

If the high speed network board 19 is inserted into the expansion slot 17, it becomes possible to access the network and the crystal oscillator 13*a* which generates clocks for the tone generator node is disabled in order to establish external synchronization. Sampling clocks are generated from the sync signal data received from the network and supplied to the tone generator. Synchronously with the sampling clocks, each sampling event of waveform data is read from the waveform memory to produce sounds.

Figure 3:
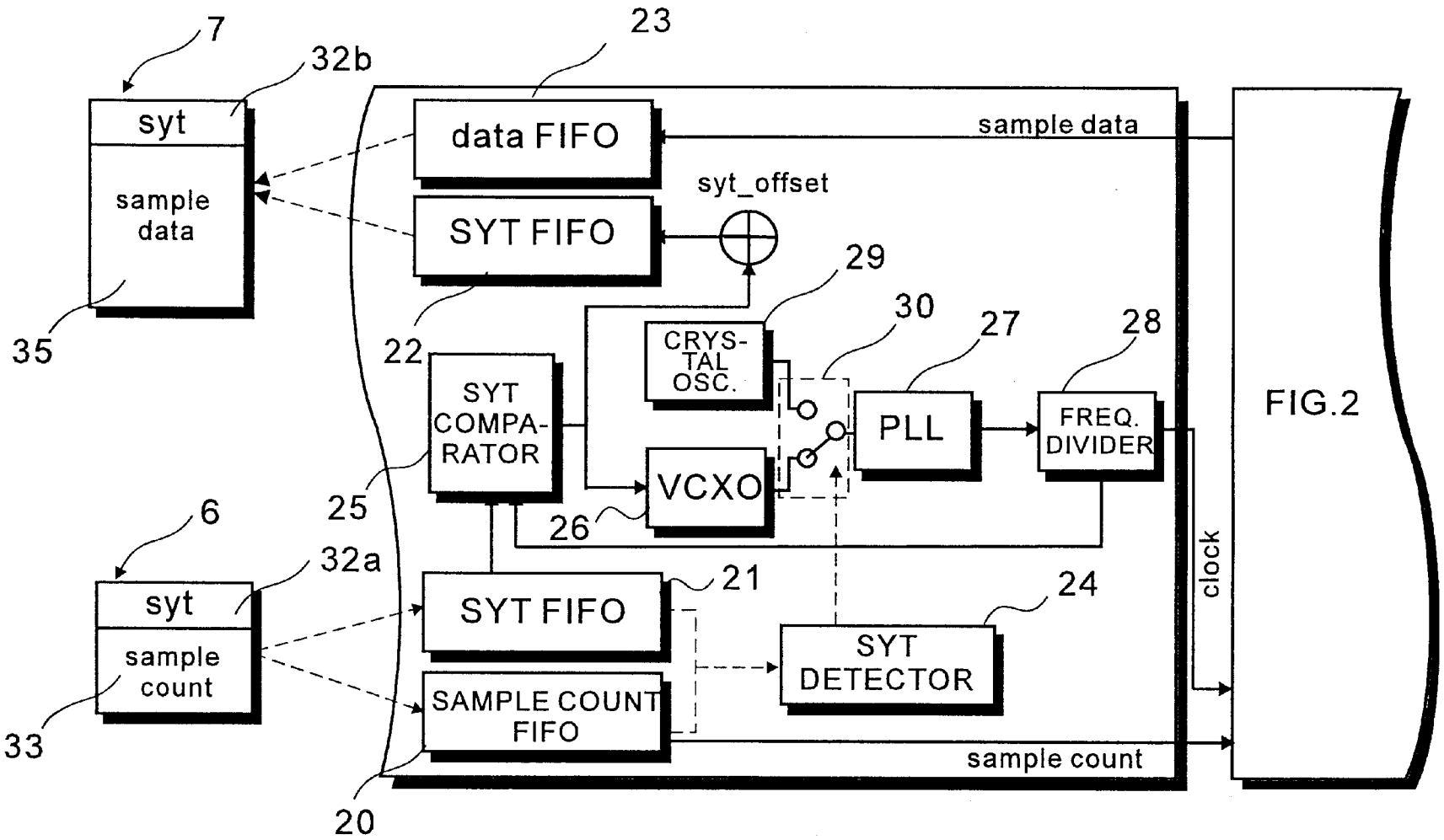
FIG. 3 is a block diagram showing the structure of a high speed network board to be inserted into an expansion slot.

FIG. 3 is a block diagram showing the structure of the high speed network board 19 to be inserted into the expansion slot 17 shown in FIG. 2.

The high speed network board 19 has: a sample count FIFO 20; a first system clock FIFO 21; a second system clock FIFO 22; a data FIFO 23; an SYT detector 24; an SYT comparator 25; a voltage controlled oscillator VCXO 26; a phase locked loop PLL 27; a frequency divider 28; a crystal oscillator 29; and a switch 30.

The network board 19 has also a communications interface in conformity with the specifications of IEEE 1394 or USB. The network board 19 may be provided with a decoder for decoding packet data, an encoder for packetizing data, and the like.

A WC packet 6 sent from the master clock node 1 (FIG. 1) includes a system clock SYT 32*a* and a sample count 33.

A data packet 7 to be transmitted to another node on the network includes an offset system clock SYT 32*b* and sample data 35.

A received WC packet 6 is decoded and separated into the system clock SYT 32*a* and sample count 33.

After sample counts 33 are stored in the sample count FIFO 20, they are sent to the SYT detector 24 and internal circuit of the node (FIG. 2), in a first-in first-out manner. After system clocks SYT 32*a* are stored in the system clock FIFO 21, they are sent to the SYT detector 24 and SYT comparator 25, in a first-in first-out manner.

If the input SYT 32*a* is not abnormal, the SYT detector 24 does not perform any particular operation. However, if there is any abnormality such as no reception of SYT 32*a* or reception of SYT 32*a* at a timing different from a predetermined timing, the SYT detector 24 operates to change the input connection to PLL 27 of the switch 30 from VCXO 26 to the crystal oscillator 29. When system clocks SYT 32*a* are thereafter input at a predetermined interval, the SYT detector 24 operates to change the input connection to PLL 27 of the switch 30 from the crystal oscillator 29 to VCXO 26.

System clocks SYT 32*a* are a series of predictable timing data such as 0, 8000, 16000, . . . . An allowance range of the value of each system clock SYT 32*a* is preset so that an occurrence of abnormality can be detected by the SYT detector 24. Since the system clocks SYT 32*a* are to be input at a predetermined interval, if the system clock is received at a timing different from the predetermined timing, it is judged that abnormality occurred.

The crystal oscillator 29 oscillates at the same frequency as that of system clocks to be generated by VCXO 26 under the control of SYT 32*a*.

Even if the input to PLL 27 is switched, PLL 27 changes the system clocks smoothly to the switched system clocks. For example, even if the system clocks are changed to the internal crystal oscillator 29 because of abnormal SYT, transition to these system clocks can be performed without any abrupt change in the clocks. The structure of PLL 27 will be later described with reference to FIG. 5.

The SYT comparator 25 compares the system clock SYT 32*a* read from the system clock FIFO 21 with the clock supplied from VCXO 26, frequency-multiplexed by PLL 27 and frequency-divided by the frequency divider 28, and outputs the comparison result to VCXO 26 and toward the second system clock FIFO 22.

VCXO 26 generates clocks in accordance with the comparison output from the SYT comparator 25.

The clocks generated by VCXO 26 are frequency-multiplexed by PLL 27, frequency-divided by the frequency divider 28, supplied to the internal circuit of the node, and fed back to the SYT comparator 25.

In accordance with the supplied clocks, the tone generator (FIG. 2) loads sample data 35 in the data FIFO 23 in a first-in first-out manner.

The comparison result by the SYT comparator 25 output toward the second system clock FIFO 22 is added with a system offset, and loaded as an offset system clock 32*b* in the second system clock FIFO 22 in a first-in first-out manner.

Data stored in the data FIFO 23 and second system count FIFO 22 is packetized and transmitted to the network as a data packet 7.

Figure 4:
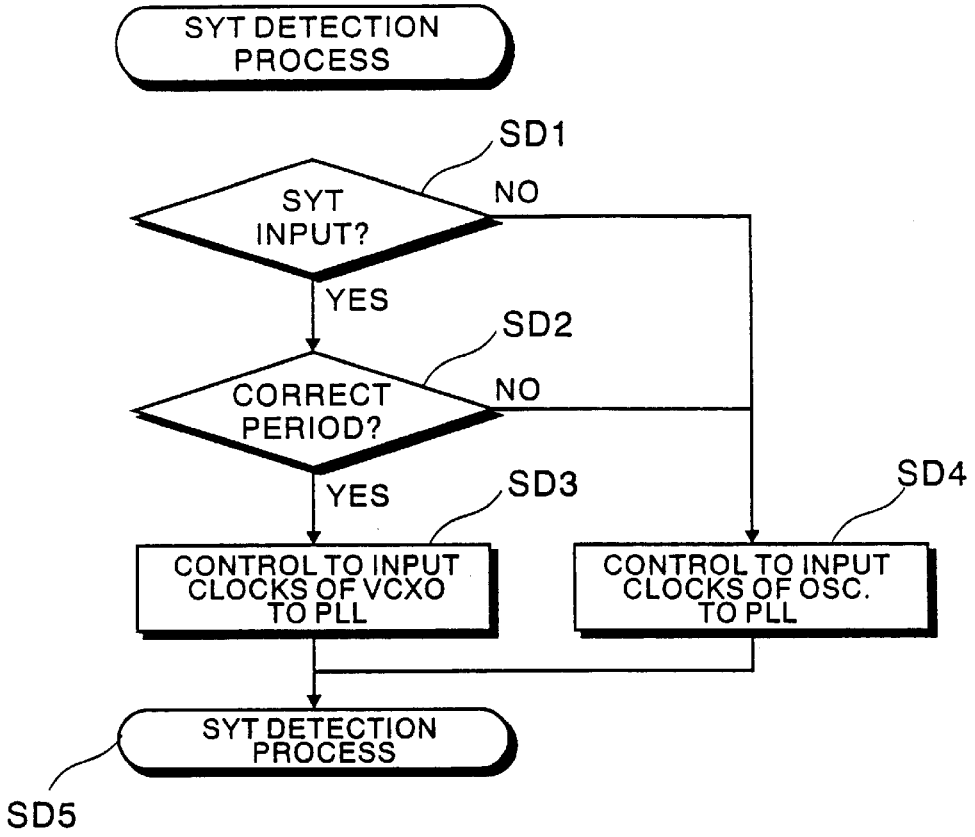
FIG. 4 is a flow chart illustrating a process to be executed by an SYT detector.

FIG. 4 is a flow chart illustrating the operation to be executed by the SYT detector 24 shown in FIG. 3. The program illustrated in the flow chart of FIG. 4 is executed by a correct period that the system clocks SYT are to be input or at a shorter period than the correct period. The correct period is a period which satisfies both a nearly equal interval of values of the system clocks SYT and a nearly equal interval of input timings of the system clocks SYT.

At Step SD1, it is checked whether there is any input SYT. If there is any input SYT, the flow advances to next Step SD2 indicated by an "YES" arrow, whereas if there is no input SYT, the flow advances to Step SD4 indicated by a "NO" arrow.

At Step SD2, it is checked whether the input system clocks SYT have the correct period. For example, assuming that the system clocks SYT increase by a unit of 8000 with an allowance of ±400, it is checked whether the difference between the present and previous system clocks SYT is in the allowance range.

This check may be performed by checking whether a difference between a difference between the next previous SYT and the previous SYT and a difference between the previous SYT and the present SYT is in a preset error range.

In addition to checking the interval of SYT values, the interval of input timings of system clocks SYT is checked. For example, an allowance range of the interval of input timings is preset and the interval between the previous and present system clocks is checked, or a difference between a difference between the input timings of the next previous SYT and the previous SYT and a difference of the input timings between the previous SYT and the present SYT is checked whether it is in a preset error range.

If the input SYT has the correct period, the flow advances to next Step SD3 indicated by an "YES" arrow, whereas if not, the flow advances to step SD4 indicated by a "NO" arrow.

At Step SD3, the switch 30 (FIG. 3) is controlled to input the clocks generated by VCXO 26 to PLL 27.

In this case, if the clocks generated by VCXO 26 are already input to PLL 27, the switch 30 maintains its connection. However, if after the clocks generated by the internal crystal oscillator 29 are input to PLL 27 because of abnormality of the network, the normal state of the network is recovered, then the switch 30 is controlled to input the clocks generated by VCXO 26 to PLL 27.

The SYT detector 24 therefore detects not only a network abnormality but also a recovery of the normal state of the network. Therefore, when the network recovers its normal state, the external system clocks are used for synchronization. Next, the flow advances to Step SD5 as indicated by an arrow.

If there is no input of SYT or the input SYT does not have the correct period, at Step SD4 the switch 30 is controlled to input the clocks generated by the internal crystal oscillator 29 to PLL 27. Next, the flow advances to Step SD5 as indicated by the arrow.

At Step SD5 the SYT detection process is repeated starting from Step SD1. By repeating the SYT detection process described above, abnormality of the network can be monitored always. When a network abnormality occurs, the clocks can be switched immediately to the clocks generated by the internal crystal oscillator 29. When the network abnormality is corrected and the clocks SYT can be input again normally, the clocks can be switched to the external clocks. With the SYT detection process, external and internal clocks can be used properly in a switching manner.

When clocks are switched from the external clocks to the internal clocks or vice versa, abnormal noises are generated because of a phase difference between the internal and external clocks.

It is therefore necessary to make smooth the clock switching operation and prevent generation of abnormal noises. To this end, PLL 27 to be detailed below is provided.

Figure 5:
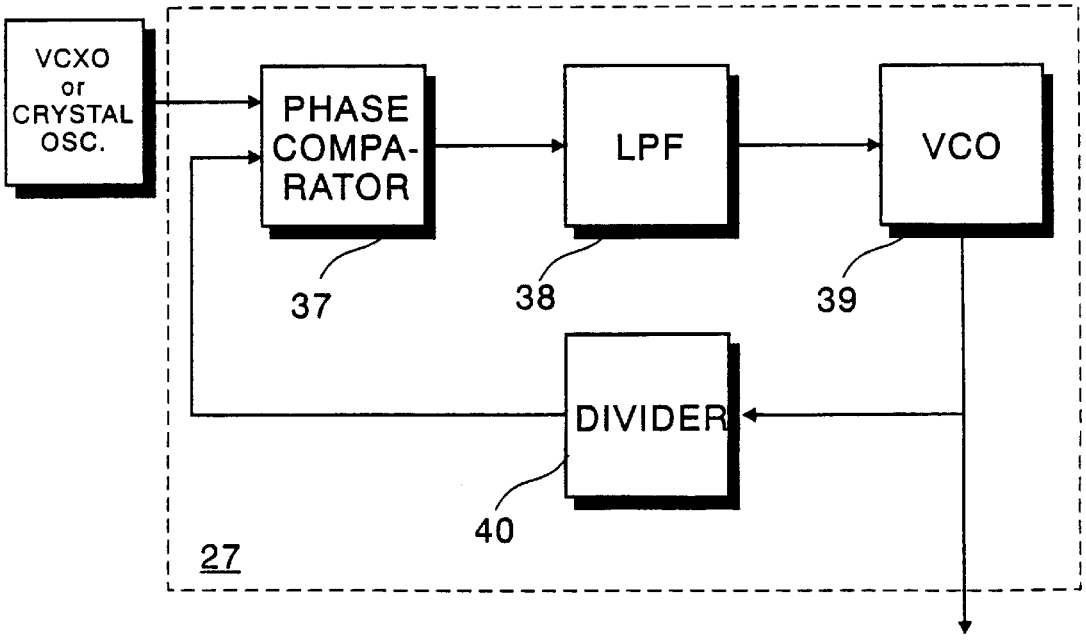
FIG. 5 is a block diagram showing the structure of a PLL circuit.

FIG. 5 is a block diagram showing the structure of PLL 27.

PLL 27 has a phase comparator 37, a low-pass filter LPF 38, a voltage controlled oscillator VCO 39, and a frequency divider 40.

A clock from VCXO 26 or crystal oscillator 29 is input to the phase comparator 37. The phase comparator 37 compares the phase of the input clock with the phase of a clock fed back from the frequency divider 40 to be later described, and outputs the comparison result. For example, the phase comparator 37 compares the phases of clocks at their rising edges. If it is judged that the phase of the fed-back clock is a lead phase relative to that of the input clock, the phase comparator 37 outputs a negative level, whereas if it is judged as a lag phase, the phase comparator 37 outputs a positive level. If both the phases are coincident, an instantaneous positive level is output.

The comparison result is supplied to LPF 38. If the phase difference is a lead phase or lag phase, the comparison result is integrated by LPF 38 to gently raise or lower the comparison result output voltage. In accordance with this gentle rise or fall of the output voltage, VCO 39 at the next stage of LPF 38 gently changes its oscillation frequency toward the frequency of the input clock. If both the phases are coincide, the output of LPF 38 has a zero level so that the output frequency of VCO 39 does not change. An output of VCO 39 is supplied to the frequency divider 40 and fed back to the phase comparator 37. The output of VCO 39 is also supplied to the frequency divider 28 (FIG. 3) and fed back to the SYT comparator 25 (FIG. 3).

With reference to the timing chart of FIG. 6, the clocks and signals of PLL 27 when clocks input to PLL 27 are changed from VCXO 26 to the crystal oscillator 29 will be described.

At a timing t1 before clocks input to PLL 27 are changed from VCXO 26 to the crystal oscillator 29, the phases of the input clock C4 and fed-back clock C3 are coincident since PLL 27 operates normally without input switching. Therefore, an output O1 of the phase comparator 37 takes an instantaneous positive level as indicated by an arrow having a dotted line arrow shaft at the timing t1. An output O2 of LPF 38 integrating the instantaneous positive level is equal to a zero level so that the oscillation frequency of VCO 39 does not change. The crystal oscillator 29 always oscillates at a constant frequency and outputs a clock C2 with a shifted phase (asynchronous phase) before clock switching occurs.

Next, at a timing t2 indicated by a broken line, an abnormality such as no supply of an external clock occurs and clocks input to PLL 27 are changed from VCXO 26 to the crystal oscillator 29. At the timing when clock switching occurs, the fed-back clock C3 has the same state as that before the clock switching.

Upon this clock switching, the input clock C4 to PLL 27 is changed at once to the clock C2 from the crystal oscillator 29. The switched PLL input clock C4 takes the waveform having a short pulse at the switching timing t2 and thereafter the same waveform as the crystal oscillator 29, as shown in FIG. 6.

After this clock switching, the phase comparator 37 compares the phase of the fed-back clock C3 having the same waveform as that before the clock switching with the phase of the switched PLL input clock C4, for example, at the rising edges of both the clocks.

Figure 6:
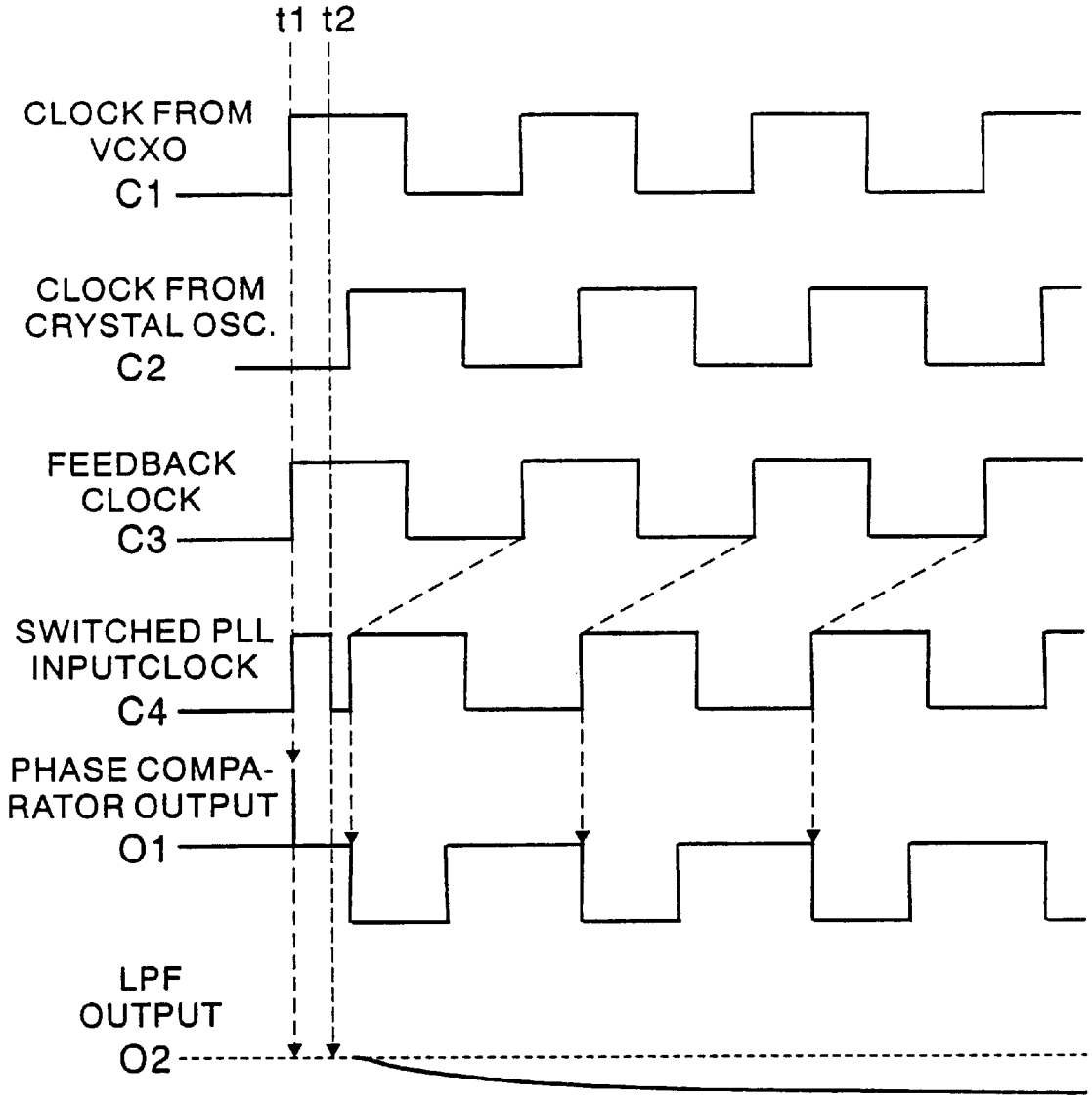
FIG. 6 is a timing chart of signals and clocks in the circuit of the high speed network board.

In the example shown in FIG. 6, the phase of the fed-back clock C3 leads that of the PLL input clock, and the phase comparator 37 outputs a negative level output O1.

LPF 38 disposed at the back stage of PLL 27 integrates the negative level output of the phase comparator 37 and outputs a gently lowering voltage as indicated at O2 in FIG. 6.

As the voltage gently lowers, VCO 39 gently lowers its oscillation frequency (increases a pulse width) toward that of the switched PLL input clock C4.

In this manner, clocks can be switched generally continuously (dynamically) without a large change in clocks when the clock switching occurs. In order to prevent a large change in clocks when the clock switching occurs, the switch 30 is required to be disposed at the front stage of PLL 27.

If the switched PLL input clock is not processed by PLL 27 but output directly to generate tone generator clocks, clocks change abruptly and some problem such as generation of abnormal noises occur.

If the switch 30 is disposed at the back stage of the back stage of PLL 27, similar problems occur.

Figure 7:
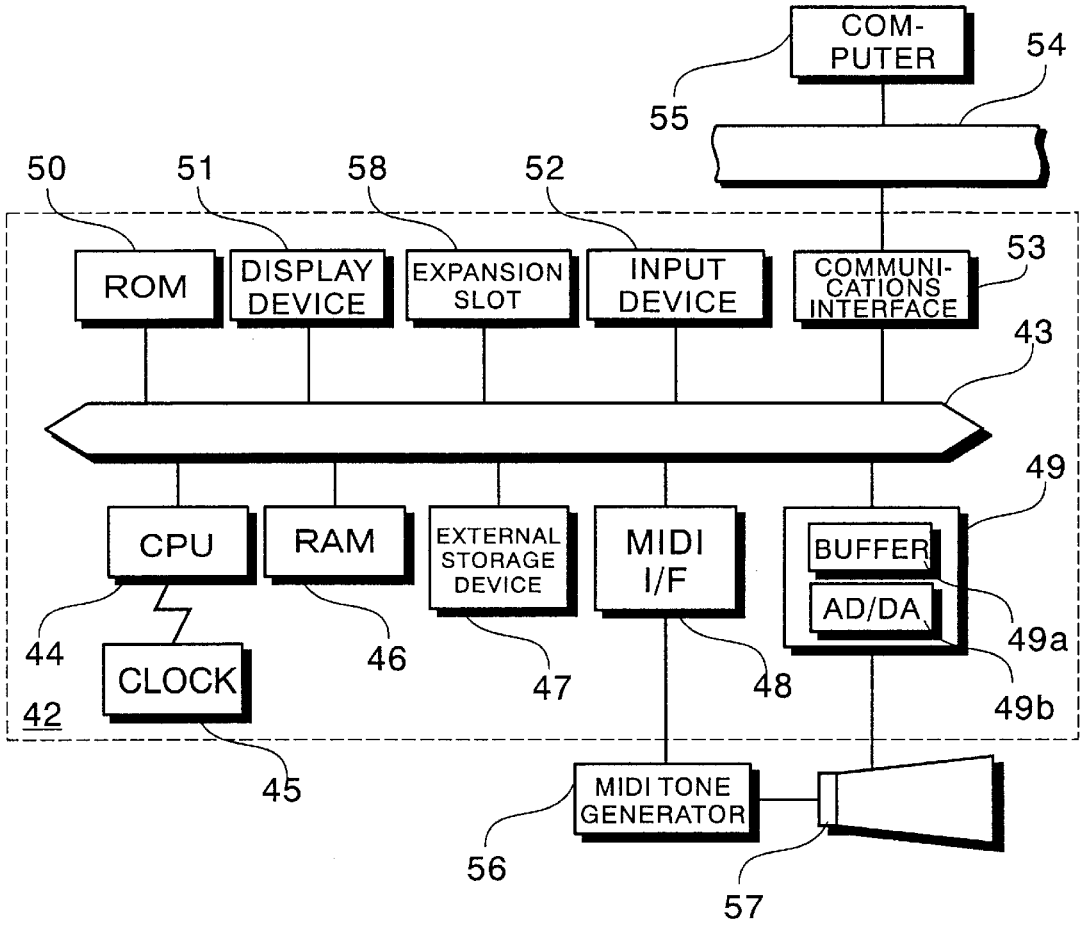
FIG. 7 is a block diagram showing the specific hardware structure of a general computer or personal computer.

FIG. 7 is a block diagram showing the specific hardware structure of a general computer or personal computer 42 constituting a node.

The structure of the general computer or personal computer 42 will be described. Connected to a bus 43 are a CPU 44, a RAM 46, an external storage device 47, a MIDI interface 48 for transferring MIDI data to and from an external, a sound card 49, a ROM 50, a display device 51, an input device 52 such as a keyboard, a switch and a mouse, a communications interface 53 for connection to a communication network, and an expansion slot 58.

The sound card 49 has a buffer 49*a* and a codec circuit 49*b*. The buffer 49*a* buffers data to be transferred to and from an external. The codec circuit 49*b* has an A/D converter and a D/A converter, which can convert data between analog and digital data. The codec circuit 49*b* has also a compression/expansion circuit and can compress/expand data.

The external storage device 47 is, for example, a hard disk drive, a floppy disk drive, a CD-ROM drive, a magnetooptical disk drive or the like, and can store MIDI data, audio data, video data, computer programs and the like.

ROM 50 stores computer programs and various parameters. RAM 46 has a working area such as buffers and registers, and can copy the contents stored in the external storage device 47 and store them.

CPU 44 executes various arithmetic operations and signal processing in accordance with the computer programs stored in ROM 50 or RAM 46. A system clock 45 generates time data. CPU 44 can execute a timer interrupt process by using the time data fetched from the system clock 45.

The communications interface 53 of the general computer or personal computer 42 is connected to the communications network 54. The communications interface 53 is an interface for transferring MIDI data, audio data, video data, computer programs and the like to and from the communications network 54.

The MIDI interface 48 is connected to a MIDI tone generator 56, and the sound card 49 is connected to a sound system 57. CPU 44 receives MIDI data, audio data, video data, computer programs and the like from the communications network 54 via the communications interface 53.

The communications interface 53 may be an Internet interface, an Ethernet interface, an IEEE 1394 digital communications interface, or an RS-232C interface for connection to various networks.

The general computer or personal computer 42 stores computer programs for reception, reproduction and the like of audio data. The external storage device 47 stores computer programs, various parameters and the like which RAM 46 reads to facilitate addition, version-up and the like of computer programs and the like.

A CD-ROM (compact disk read-only memory) drive is a device for reading computer programs or the like stored in a CD-ROM. The read computer programs or the like are stored in a hard disk to facilitate new installation, version-up and the like of computer programs or the like.

The communications interface 53 is connected to the communications network 54 such as a LAN (local area network), the Internet and a telephone line, for connection to another computer 55 via the communications network 54.

If the computer programs or the like are not stored in the external storage device 47, the computer programs or the like may be downloaded from the computer 55. The general computer or personal computer 42 transmits a request for downloading the computer programs or the like to the computer 55 via the communications interface 53 and communications network 54.

Upon reception of this command, the computer 55 transmits the requested computer programs or the like to the general computer or personal computer 42 via the communications network 32. The general computer or personal computer 42 receives the computer programs or the like from the communications interface 53 and stores them in the external storage device 47 to thus complete downloading.

The computer programs or the like realizing the functions of this embodiment may be installed in a commercially available general computer or personal computer.

In such a case, the computer programs or the like realizing the functions of the embodiment may be stored in a computer readable storage medium such as a CD-ROM and a floppy disk and supplied to users.

If the general computer, personal computer or the like is connected to the communications network such as a LAN, the Internet and a telephone line, the computer programs, various data and the like may be supplied to the personal computer or the like via the communications network.

The high speed network board of this embodiment may be inserted into an expansion slot of a commercially available general computer or personal computer.

The present invention has been described in connection with the preferred embodiments. The invention is not limited only to the above embodiments. It is apparent that various modifications, improvements, combinations, and the like can be made by those skilled in the art.

What are claimed are:

1. A musical tone signal processing apparatus which synchronizes a read timing of a reader unit for reading a musical tone signal from a memory at least temporarily storing the musical tone signal, the musical tone signal processing apparatus comprising:

a master clock input unit for externally inputting a master clock information used for synchronizing the read timing of the musical tone signal;

a first sync clock generator unit for generating a first sync clock used for synchronizing the read timing of the musical tone signal, in accordance with the master clock information externally input;

a second sync clock generator unit for generating a second sync clock used for synchronizing the read timing of the musical tone signal, separately from the first sync clock;

a detector unit for detecting an abnormality of an input state of the master clock information; and a sync clock switching unit for changing a sync clock used for reading the musical tone signal from the first sync clock to the second sync clock, when said detector unit detects the abnormality of the input state of the master clock information.

2. A musical tone signal processing apparatus according to claim 1, wherein said detector unit detects the abnormality if the master clock information is not input in a predetermined time.

3. A musical tone signal processing apparatus according to claim 1, wherein said detector unit detects the abnormality if the master clock information is not input at a predetermined input interval.

4. A musical tone signal processing apparatus according to claim 3, wherein said detector unit detects the abnormality if an interval of values of a previous input master clock information and a present input master clock information is not in a predetermined range.

5. A musical tone signal processing apparatus according to claim 3, wherein said detector unit detects the abnormality if an interval of timings of a previous input master clock information and a present input master clock information is not in a predetermined range.

6. A musical tone signal processing apparatus according to claim 1, wherein the musical tone signal corresponds to a sampling event for waveform data.

7. A musical tone signal processing apparatus according to claim 1, further comprising:

a memory for storing the musical tone signal; and a reader unit for reading the musical tone signal from said memory synchronously with the sync clock.

8. A musical tone signal processing apparatus according to claim 1, further comprising:

a phase comparator for comparing phases of two inputs and outputting a positive level signal or a negative level signal;

a low-pass filter for integrating an output from said phase comparator and raising or lowering an output voltage of said low-pass filter;

a voltage controlled oscillator for raising or lowering an oscillation frequency in accordance with the raised or lowered output voltage of said low-pass filter; and a frequency divider for frequency-dividing an output of said voltage controlled oscillator and feeding back a frequency-divided signal to said phase comparator, wherein the frequency-divided signal fed back from said frequency divider is supplied to one input of said phase comparator and the first or second sync clock output from said sync clock switching unit is input to the other input of said phase comparator.

9. A musical tone signal processing apparatus which synchronizes a read timing of a reader unit for reading a musical tone signal from a memory at least temporarily storing the musical tone signal, the musical tone signal processing apparatus comprising:

a master clock input unit for externally inputting a master clock information used for synchronizing the read timing of the musical tone signal;

a first sync clock generator unit for generating a first sync clock used for synchronizing the read timing of the musical tone signal, in accordance with the master clock information externally input;

second sync clock generator unit for generating a second sync clock used for synchronizing the read timing of the musical tone signal, separately from the first sync clock;

a detector unit for detecting a recovery of a normal state from an abnormal state of an input state of the master clock information; and a sync clock switching unit for changing a sync clock used for reading the musical tone signal from the second sync clock to the first sync clock, when said detector unit detects the recovery of the normal state from the abnormal state of the input of the master clock information.

10. A musical tone signal processing apparatus according to claim 9, wherein:

said detector unit detects also an abnormality of the input state of the master clock information; and said sync clock switching unit changes the sync clock used for reading the musical tone signal from the first sync clock to the second sync clock, when said detector unit detects the abnormality of the input state of the master clock information.

11. A musical tone signal processing apparatus according to claim 9, wherein said detector unit detects the recovery of the normal state if a state that the master clock information is not input at a predetermined input interval is changed to a state that the master clock information is input at the predetermined input interval.

12. A musical tone signal processing apparatus according to claim 9, wherein said detector unit detects the recovery of the normal state if a state that an interval of values of a previous input master clock information and a present input master clock information is not in a predetermined range is changed to a state in the predetermined range.

13. A musical tone signal processing apparatus according to claim 9, wherein said detector unit detects the recovery of the normal state if a state that an interval of timings of a previous input master clock information and a present input master clock information is not in a predetermined range is changed to a state in the predetermined range.

14. A musical tone signal processing apparatus according to claim 9, wherein the musical tone signal corresponds to a sampling event for waveform data.

15. A musical tone signal processing apparatus according to claim 9, further comprising:

a memory for storing the musical tone signal; and a reader unit for reading the musical tone signal from said memory synchronously with the sync clock.

16. A musical tone signal processing apparatus according to claim 9, further comprising:

a phase comparator for comparing phases of two inputs and outputting a positive level signal or a negative level signal;

a low-pass filter for integrating an output from said phase comparator and raising or lowering an output voltage of said low-pass filter;

a voltage controlled oscillator for raising or lowering an oscillation frequency in accordance with the raised or lowered output voltage of said low-pass filter; and a frequency divider for frequency-dividing an output of said voltage controlled oscillator and feeding back a frequency-divided signal to said phase comparator, wherein the frequency-divided signal fed back from said frequency divider is supplied to one input of said phase comparator and the first or second sync clock output from said sync clock switching unit is input to the other input of said phase comparator.

17. A musical tone signal processing system comprising:

a master clock generating unit including a master clock information generator for generating a master clock information used for synchronizing a read timing of a musical tone signal at a node connected to a network and a transmitter for transmitting the generated master clock information; and a musical tone signal processing apparatus which synchronizes a read timing of a reader unit for reading a musical tone signal from a memory at least temporarily storing the musical tone signal, the musical tone signal processing apparatus comprising: a master clock input unit for externally inputting the master clock information used for synchronizing the read timing of the musical tone signal;

a first sync clock generator unit for generating a first sync clock used for synchronizing the read timing of the musical tone signal, in accordance with the master clock information externally input; a second sync clock generator unit for generating a second sync clock used for synchronizing the read timing of the musical tone signal, separately from the first sync clock; a detector unit for detecting an abnormality of an input state of the master clock information; and a sync clock switching unit for changing a sync clock used for reading the musical tone signal from the first sync clock to the second sync clock, when the detector unit detects the abnormality of the input state of the master clock information.

18. A musical tone signal processing system comprising:

a master clock generating unit including a master clock information generator for generating a master clock information used for synchronizing a read timing of a musical tone signal at a node connected to a network and a transmitter for transmitting the generated master clock information; and a musical tone signal processing apparatus which synchronizes a read timing of a reader unit for reading a musical tone signal from a memory at least temporarily storing the musical tone signal, the musical tone signal processing apparatus comprising: a master clock input unit for externally inputting the master clock information used for synchronizing the read timing of the musical tone signal;

a first sync clock generator unit for generating a first sync clock used for synchronizing the read timing of the musical tone signal, in accordance with the master clock information externally input; a second sync clock generator unit for generating a second sync clock used for synchronizing the read timing of the musical tone signal, separately from the first sync clock; a detector unit for detecting a recovery of a normal state from an abnormal state of an input state of the master clock information; and a sync clock switching unit for changing a sync clock used for reading the musical tone signal from the second sync clock to the first sync clock, when the detector unit detects the recovery of the normal state from the abnormal state of the input of the master clock information.

19. A musical tone signal processing system according to claim 18, wherein:

the detector unit detects also an abnormality of the input state of the master clock information; and the sync clock switching unit changes the sync clock used for reading the musical tone signal from the first sync clock to the second sync clock, when the detector unit detects the abnormality of the input state of the master clock information.

20. A musical tone signal processing method which synchronizes a read timing of a reader unit for reading a musical tone signal from a memory at least temporarily storing the musical tone signal, the musical tone signal processing method comprising the steps of:

externally inputting a master clock information used for synchronizing the read timing of the musical tone signal;

generating a first sync clock used for synchronizing the read timing of the musical tone signal, in accordance with the master clock information externally input;

generating a second sync clock used for synchronizing the read timing of the musical tone signal, separately from the first sync clock;

detecting an abnormality of an input state of the master clock information; and changing a sync clock used for reading the musical tone signal from the first sync clock to the second sync clock, when the abnormality of the input state of the master clock information is detected at said detecting step.

21. A musical tone signal processing method which synchronizes a read timing of a reader unit for reading a musical tone signal from a memory at least temporarily storing the musical tone signal, the musical tone signal processing method comprising the steps of:

externally inputting a master clock information used for synchronizing the read timing of the musical tone signal;

generating a first sync clock used for synchronizing the read timing of the musical tone signal, in accordance with the master clock information externally input;

generating a second sync clock used for synchronizing the read timing of the musical tone signal, separately from the first sync clock;

detecting a recovery of a normal state from an abnormal state of an input state of the master clock information; and changing a sync clock used for reading the musical tone signal from the second sync clock to the first sync clock, when the recovery of the normal state from the abnormal state of the input of the master clock information is detected at said detecting step.

22. A musical tone signal processing method according to claim 21, wherein:

an abnormality of the input state of the master clock information is also detected at said detecting step; and the sync clock used for reading the musical tone signal is changed from the first sync clock to the second sync clock at said changing step, when the abnormality of the input state of the master clock information is detected at said detecting step.

23. A musical tone signal processing method which synchronizes in a network, the network including a master node and other node, a read timing of a reader unit of the other node for reading a musical tone signal from a memory at least temporarily storing the musical tone signal, the musical tone signal processing method comprising the steps of:

generating at the master node a master clock information used for synchronizing a read timing of a musical tone signal at the other node connected to a network;

transmitting the generated master clock information from the master node to the other node;

inputting the master clock information used for synchronizing the read timing of the musical tone signal at the other node;

generating at the other node a first sync clock used for synchronizing the read timing of the musical tone signal, in accordance with the master clock information input;

generating at the other node a second sync clock used for synchronizing the read timing of the musical tone signal, separately from the first sync clock;

detecting an abnormality of an input state of the master clock information at the other node; and changing a sync clock used for reading the musical tone signal from the first sync clock to the second sync clock at the other node, when the abnormality of the input state of the master clock information is detected at the detecting step.

24. A musical tone signal processing method which synchronizes in a network, the network including a master node and other node, a read timing of a reader unit of the other node for reading a musical tone signal from a memory at least temporarily storing the musical tone signal, the musical tone signal processing method comprising the steps of:

generating at the master node a master clock information used for synchronizing a read timing of a musical tone signal at the other node connected to a network;

transmitting the generated master clock information from the master node to the other node;

inputting the master clock information used for synchronizing the read timing of the musical tone signal at the other node;

generating at the other node a first sync clock used for synchronizing the read timing of the musical tone signal, in accordance with the master clock information input;

generating at the other node a second sync clock used for synchronizing the read timing of the musical tone signal, separately from the first sync clock;

detecting a recovery of a normal state from an abnormal state of an input state of the master clock information at the other node; and changing a sync clock used for reading the musical tone signal from the second sync clock to the first sync clock at the other node, when the recovery of the normal state from the abnormal state of the input of the master clock information is detected at the detecting step.

25. A musical tone signal processing method according to claim 24, wherein:

an abnormality of the input state of the master clock information is also detected at the detecting step; and the sync clock used for reading the musical tone signal is changed from the first sync clock to the second sync clock at changing step, when the abnormality of the input state of the master clock information is detected at the detecting step.

26. A storage medium storing a program, which a computer executes to realize a musical tone signal process which synchronizes a read timing of a reader unit for reading a musical tone signal from a memory at least temporarily storing the musical tone signal, comprising the instructions for:

externally inputting a master clock information used for synchronizing the read timing of the musical tone signal;

generating a first sync clock used for synchronizing the read timing of the musical tone signal, in accordance with the master clock information externally input;

generating a second sync clock used for synchronizing the read timing of the musical tone signal, separately from the first sync clock;

detecting an abnormality of an input state of the master clock information; and changing a sync clock used for reading the musical tone signal from the first sync clock to the second sync clock, when the abnormality of the input state of the master clock information is detected by said detecting instruction.

27. A storage medium storing a program, which a computer executes to realize a musical tone signal process which synchronizes a read timing of a reader unit for reading a musical tone signal from a memory at least temporarily storing the musical tone signal, comprising the instructions for:

externally inputting a master clock information used for synchronizing the read timing of the musical tone signal;

generating a first sync clock used for synchronizing the read timing of the musical tone signal, in accordance with the master clock information externally input;

generating a second sync clock used for synchronizing the read timing of the musical tone signal, separately from the first sync clock;

detecting a recovery of a normal state from an abnormal state of an input state of the master clock information; and changing a sync clock used for reading the musical tone signal from the second sync clock to the first sync clock, when the recovery of the normal state from the abnormal state of the input of the master clock information is detected by said detecting instruction.

28. A storage medium storing a program according to claim 27, wherein:

an abnormality of the input state of the master clock information is also detected by said detecting instruction; and the sync clock used for reading the musical tone signal is changed from the first sync clock to the second sync clock by said changing instruction, when the abnormality of the input state of the master clock information is detected by said detecting instruction.

29. A storage medium storing a program, which a computer executes to realize a musical tone signal process which synchronizes in a network, the network including a master node and other node, a read timing of a reader unit of the other node for reading a musical tone signal from a memory at least temporarily storing the musical tone signal, comprising the instructions for:

generating at the master node a master clock information used for synchronizing a read timing of a musical tone signal at the other node connected to a network;

transmitting the generated master clock information from the master node to the other node;

inputting the master clock information used for synchronizing the read timing of the musical tone signal at the other node;

generating at the other node a first sync clock used for synchronizing the read timing of the musical tone signal, in accordance with the master clock information input;

generating at the other node a second sync clock used for synchronizing the read timing of the musical tone signal, separately from the first sync clock;

detecting an abnormality of an input state of the master clock information at the other node; and changing a sync clock used for reading the musical tone signal from the first sync clock to the second sync clock at the other node, when the abnormality of the input state of the master clock information is detected by the detecting instruction.

30. A storage medium storing a program, which a computer executes to realize a musical tone signal process which synchronizes in a network, the network including a master node and other node, a read timing of a reader unit of the other node for reading a musical tone signal from a memory at least temporarily storing the musical tone signal, comprising the instructions for:

generating at the master node a master clock information used for synchronizing a read timing of a musical tone signal at the other node connected to a network;

transmitting the generated master clock information from the master node to the other node;

inputting the master clock information used for synchronizing the read timing of the musical tone signal at the other node;

generating at the other node a first sync clock used for synchronizing the read timing of the musical tone signal, in accordance with the master clock information input;

generating at the other node a second sync clock used for synchronizing the read timing of the musical tone signal, separately from the first sync clock;

detecting a recovery of a normal state from an abnormal state of an input state of the master clock information at the other node; and changing a sync clock used for reading the musical tone signal from the second sync clock to the first sync clock at the other node, when the recovery of the normal state from the abnormal state of the input of the master clock information is detected by the detecting instruction.

31. A storage medium for a program according to claim 30, wherein:

an abnormality of the input state of the master clock information is also detected by said detecting instruction; and the sync clock used for reading the musical tone signal is from the first sync clock changed to the second sync clock by said changing instruction, when the abnormality of the input state of the master clock information is detected by said detecting instruction.

* * * * *